US009032928B2

(12) United States Patent
Abell et al.

(10) Patent No.: US 9,032,928 B2
(45) Date of Patent: May 19, 2015

(54) HANDLES FOR STARTER PULL CORDS

(75) Inventors: Cameron Abell, Nanaimo (CA); Paul Abell, Nanaimo (CA)

(73) Assignee: MARVEL INNOVATIONS INC., Vancouver (CA)

( * ) Notice: Subject to any disclaimer, the term of this patent is extended or adjusted under 35 U.S.C. 154(b) by 275 days.

(21) Appl. No.: 13/639,906

(22) PCT Filed: Apr. 8, 2011

(86) PCT No.: PCT/CA2011/000370

§ 371 (c)(1),
(2), (4) Date: Oct. 8, 2012

(87) PCT Pub. No.: WO2011/123939

PCT Pub. Date: Oct. 13, 2011

(65) Prior Publication Data

US 2013/0036994 A1 Feb. 14, 2013

Related U.S. Application Data

(60) Provisional application No. 61/322,283, filed on Apr. 8, 2010.

(51) Int. Cl.

| | |
|---|---|
| ***F02N 1/00*** | (2006.01) |
| ***F02N 3/02*** | (2006.01) |
| ***F02N 5/04*** | (2006.01) |
| ***B25F 1/02*** | (2006.01) |
| ***B25G 1/08*** | (2006.01) |
| ***B25G 3/20*** | (2006.01) |
| *F02N 5/02* | (2006.01) |

(52) U.S. Cl.

CPC .. *F02N 3/02* (2013.01); *F02N 5/02* (2013.01); *F02N 5/04* (2013.01); *B25F 1/02* (2013.01); *B25G 1/08* (2013.01); *B25G 3/20* (2013.01)

(58) Field of Classification Search

CPC ..... F02N 3/02; F02N 5/02; F02N 5/04; B25G 1/00; B25G 1/08; G05G 1/00; G05G 1/02

USPC ..... 123/185.3, 185.4, 185.2; 185/39, 41 A, 185/41 R

See application file for complete search history.

(56) References Cited

U.S. PATENT DOCUMENTS

| | | | | | |
|---|---|---|---|---|---|
| 3,572,307 | A | * | 3/1971 | Harkness et al. | 123/185.2 |
| 5,153,967 | A | * | 10/1992 | Zimmermann et al. | 16/442 |
| 5,738,058 | A | * | 4/1998 | Gotto | 123/146.5 B |
| 6,014,785 | A | * | 1/2000 | Punch et al. | 7/105 |
| D432,887 | S | * | 10/2000 | Lossen | D8/85 |
| 2006/0254897 | A1 | * | 11/2006 | Hamisch et al. | 200/401 |

(Continued)

*Primary Examiner* — Mahmoud Gimie

(57) ABSTRACT

A handle for a starter pull cord having an elongate body for being grasped by a user, a stem extending downward from the elongate body and having a female portion of a quick connect/release coupling mechanism, the female portion having a core and a sleeve mounted for sliding movement thereon between engaged position and disengaged position, the sleeve being biased towards the engaged position, and a cord connector for attaching to the starter pull cord and having a male portion of the quick connect/release coupling mechanism adapted to being received within the female portion and being releasably retained therein when the sleeve is in the engaged position and being released therefrom when the sleeve is in the disengaged position. The first male portion and the female portion may include complementary interlocking portions that cooperate to prevent rotation of the first male portion relative to the female portion.

12 Claims, 9 Drawing Sheets

(56) References Cited

U.S. PATENT DOCUMENTS

2008/0295794 A1* 12/2008 Steinhauser ..... 123/185.2
2010/0011535 A1* 1/2010 Schuelke ..... 16/2.1
2010/0116104 A1* 5/2010 Hung ..... 81/490

* cited by examiner

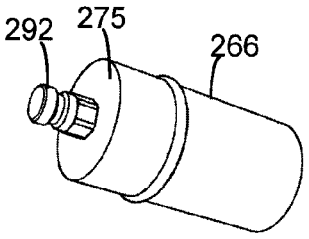
Fig. 17
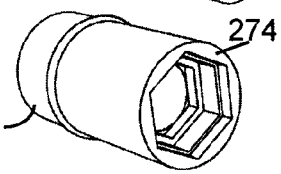
Fig. 18
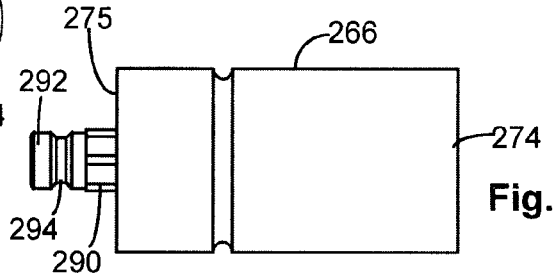
Fig. 20
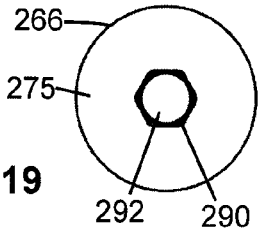
Fig. 19
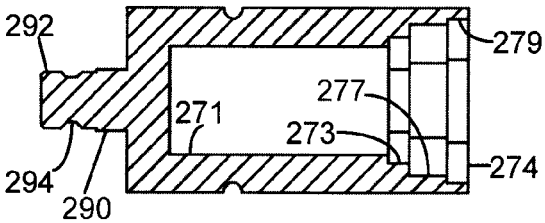
Fig. 21
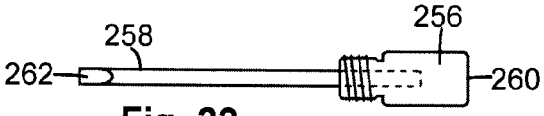
Fig. 22
Fig. 26 Fig. 27
Fig. 23
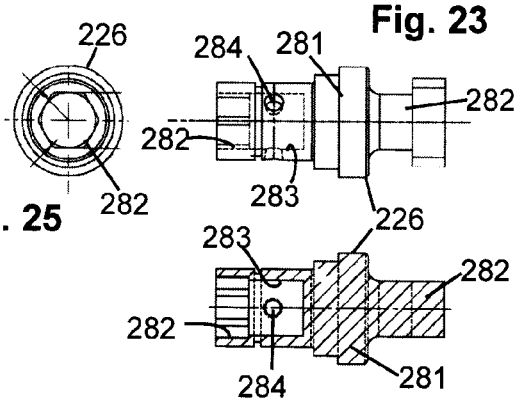
Fig. 25
Fig. 24
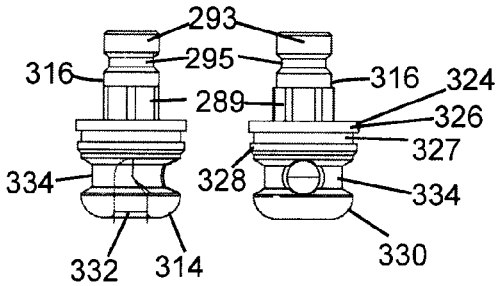

HANDLES FOR STARTER PULL CORDS

BACKGROUND OF THE INVENTION

The present invention relates generally to an improved handle for a starter pull cord of a gasoline motor driven device, and particularly to an improved ergonomic handle that is releasably connected to the starter cord and that incorporates various tools that may be relevant to the device on which the handle is employed.

Gasoline powered engines are used to power numerous kinds of devices such as power tools (i.e. chain saws, weed cutters, lawn mowers, snow blowers, leaf blowers, pumps, generators, garden tillers, etc.), snowmobiles, outboard boat motors, motorcycles and all-terrain vehicles. Many of these engines have a manual starter mechanism employing a pull cord with an attached handle to provide the initial impetus to start the engine. The pull cord is wound around a starter pulley that is connected to the engine's crankshaft. To start the engine, a user pulls on the handle of the starter cord to unwind the cord from the pulley to impart a rotational movement to the crankshaft, which provides the impetus to start the engine.

Conventional pull cord handles comprise of a simple T-shaped body that is connected to the pull cord at the stem, or D-shaped body connected to the cord at the straight portion of the handle. Conventional pull cord handles typically do not provide any additional or enhanced functionality other than as a handle.

SUMMARY OF THE INVENTION

In some aspects, the present invention provides starter cord handles that provide the user with a comfortable, ergonomic grip, and with a secure and confident grip that is not prone to slipping. In some aspects, the present invention provides starter cord handles that provide a convenient storage for relevant tools for use on the device on which the handles are employed. In some aspects, the present invention provides starter cord handles that provide the ability to be used as a handle for conventional tools or socket sets for servicing the device on which they are used, or the ability to be interchangeably used as a handle with a variety of custom tools that are relevant for the servicing of a particular powered device on which the handles are used. In some aspects, the present invention provides starter cord handles that provide the ability to be disconnected from the starter cord so that they may be used as a handle for a relevant tool for servicing the device, or enabling the handle to be stowed away from the device while the device is in use. In some aspects, the present invention provides starter cord handles that provide the ability to store a spare spark plug therein, as well as a spark plug tool, and the ability to disconnect from the started cord and connect to the spark plug tool to provide an enhanced ergonomic handle for the spark plug tool.

In some aspects the present invention provides a handle for a starter pull cord for use on a motor driven device, the handle comprising: an elongate body adapted to being grasped in a user's grasping hand; a stem portion extending downward from the elongate body and having a base portion attached to the elongate body at a position that is located between two fingers of the user's grasping hand, and a remote end opposite the base end; a female portion of a quick connect/release coupling mechanism attached to the remote end of the stem portion, the female portion comprising a core member and a sleeve mounted for sliding movement on the core member between an engaged position and a disengaged position, the sleeve being biased towards the engaged position; and a cord connector adapted to being attached to the starter pull cord and having a first male portion of the quick connect/release coupling mechanism that is adapted to being received within the female portion and being releasably retained therein when the sleeve is in the engaged position and being released therefrom when the sleeve is in the disengaged position. In some embodiments, the first male portion and the female portion may include complementary interlocking portions that cooperate when the first male portion is engaged with the female portion to prevent rotation of the first male portion relative to the female portion.

In some embodiments, the handle may include at least one cavity adapted to releasably retain therein a tool that is relevant to the device. In some embodiments, the handle may include a spark plug tool, and the one of said at least one cavity may be longitudinally aligned with the elongate body and may be adapted to receive the spark plug tool therein. In some embodiments, the said one cavity may be adapted to receive the spark plug tool and a spark plug partially retained in the spark plug tool.

In some embodiments, the handle may include may include a spark plug tool that includes a second male portion of the quick connect/release coupling mechanism that is adapted to being received within the female portion on the handle and being releasably retained therein when the sleeve is in the engaged position and being released therefrom when the sleeve is in the disengaged position.

In some embodiments, the handle may include releasable locking means on the elongate body adapted to cooperate with the spark plug tool within the elongate body to restrict removal and rotation of the spark plug tool relative to the elongate body for enabling the handle to being used in driving other tools having portions complementary to and able to connect with the second male portion on the spark plug tool.

In some embodiments, the handle may include a spark plug tool that includes at least two stepped internal hexagonal cavities, each being adapted to engage with a size of spark plug thereby enabling the spark plug tool to drive more than one sized spark plug.

In some embodiments of the handle, the elongate body may include a front end and an opposite back end, and tapers from the front end toward the back end. In some embodiments the elongate body may include a first concave indentation adjacent the front end adapted to locating the index finger of the user's grasping hand therein, and a second concave indentation to the rear of the first indentation and adapted to locating the middle finger of the user's grasping hand. In some embodiments the base portion of the stem portion is between the first indentation and the second indentation. In some embodiments the elongate body may include a top indentation adjacent the front end adapted to locate the thumb of the user's grasping hand therein.

In some aspects the present invention provides a tool kit that may comprise an embodiment of a handle as described above together with a plurality of tools, each tool having a male portion of the quick connect/release coupling mechanism that is adapted to being received within the female portion on the handle and being releasably retained therein when the sleeve is in the engaged position and being released therefrom when the sleeve is in the disengaged position. In some embodiments of the toll kit, the handle may include at least one cavity, wherein each of the at least one cavity is adapted to releasably retain therein one of said plurality of tools.

For a better understanding of the present invention and to show more clearly how it may be carried into effect, reference will now be made by way of example to the accompanying drawings.

BRIEF DESCRIPTION OF THE DRAWINGS

FIG. 17 is a perspective view of a spark plug tool of the starter pull cord handle of FIG. 10;

FIG. 18 is a perspective view of a spark plug tool of FIG. 17;

FIG. 19 is a front view of a spark plug tool of FIG. 17;

FIG. 20 is a side view of a spark plug tool of FIG. 17;

FIG. 21 is a longitudinal section view of a spark plug tool of FIG. 17;

FIG. 22 is a side view of a tool of the starter pull cord handle of FIG. 10;

FIG. 23 is a side view of a female portion of a quick connect coupling mechanism of the starter pull cord handle of FIG. 10;

FIG. 24 is a longitudinal section view of a female portion of FIG. 23;

FIG. 25 is a bottom view of a female portion of FIG. 23;

FIG. 26 is a side view of a cord connector of a quick connect coupling mechanism of the starter pull cord handle of FIG. 10;

FIG. 27 is a side view of a cord connector of FIG. 26;

DETAILED DESCRIPTION OF THE INVENTION

Figure 1:
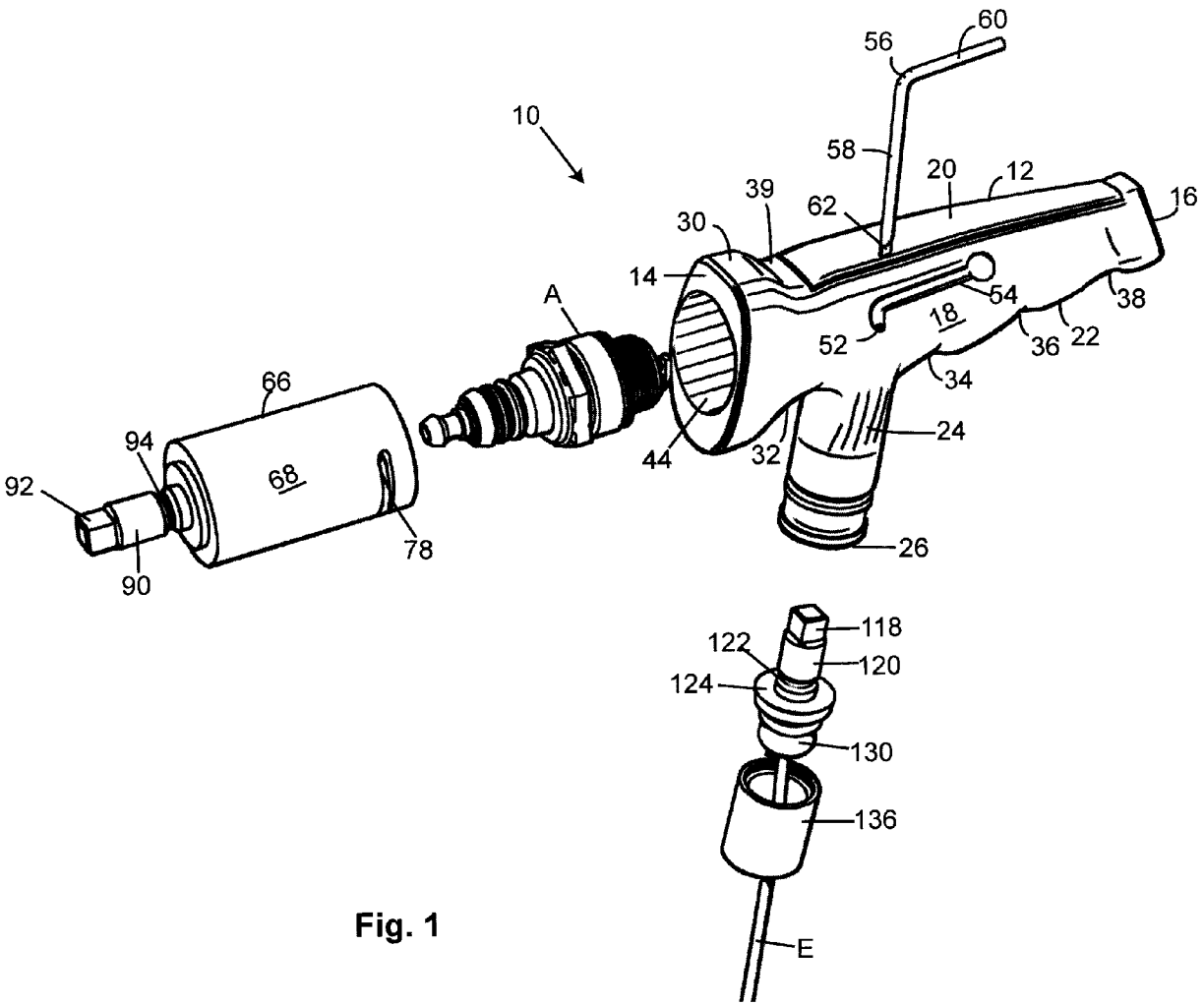
FIG. 1 is a exploded perspective view of an embodiment of a starter pull cord handle in accordance with the present invention.
Figure 2:
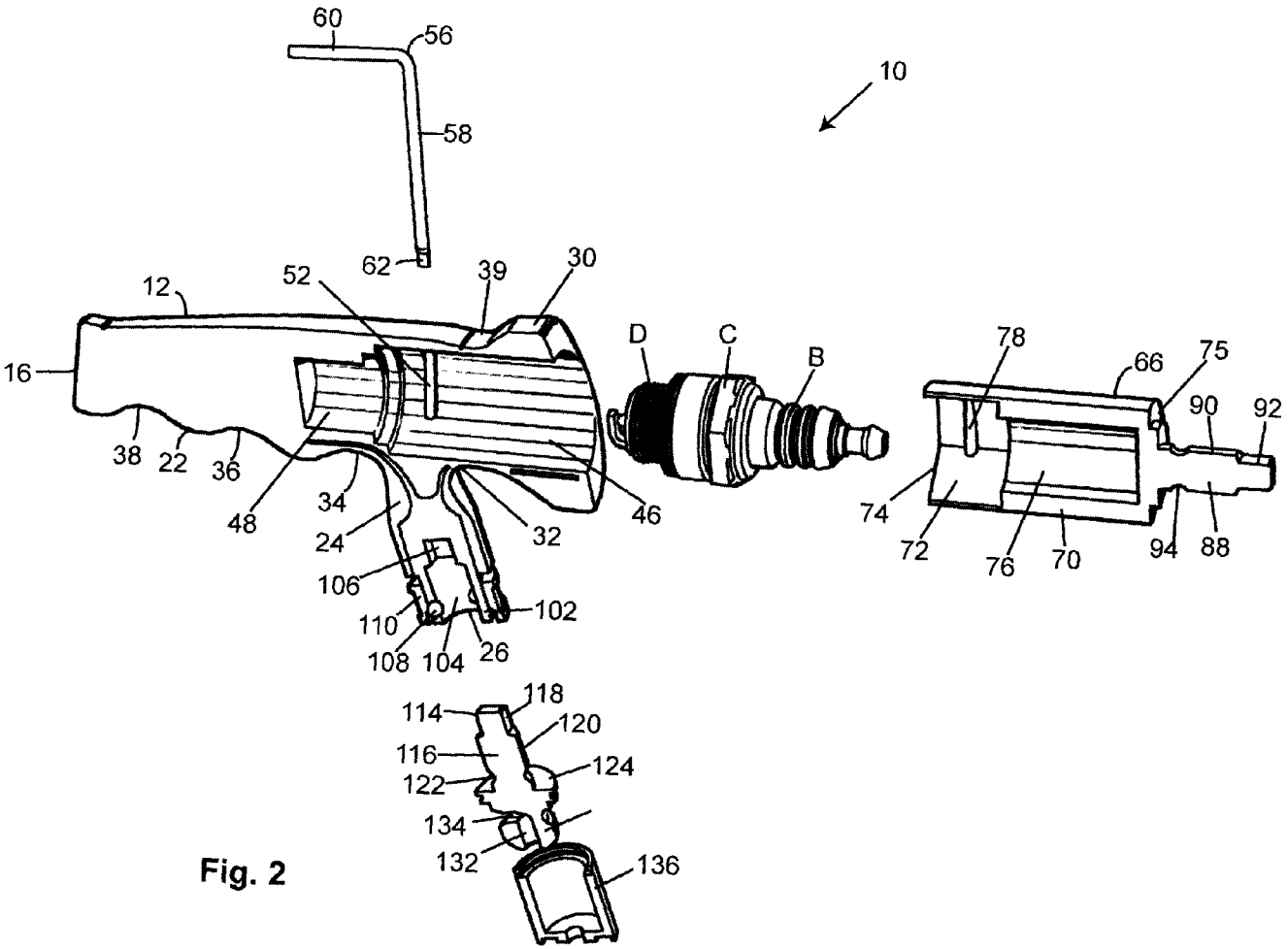
FIG. 2 is an exploded cross section from the side of the starter pull cord handle of FIG. 1.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention. Directional references such a up, down, front, back, left, right, rearward and the like refer to the device in the orientation in which it would be normally held by a user.

Referring to FIGS. 1-6, there is shown an embodiment of a starter pull cord handle, in accordance with the present invention, shown generally by reference numeral 10. Handle 10 comprises an elongate body 12 having a front end 14 and an opposite back end 16, and slightly convex side surfaces 18. The body 12 tapers from a larger cross section at the front end 14 to a smaller cross section towards the back end 14, and thereby the body 12 is adapted to more naturally conform to the inside of a user's hand while gripping the starter pull cord handle 10. The top outer surface of the body 12 may include a top panel portion 20 that smoothly tapers with the remainder of the body 12 and that may be used for branding of the handle for marketing purposes.

Starter pull cord handle 10 includes a stem portion 24 that extends from the bottom outer surface 22 of the body 12 preferably nearer the front end 14 than the back end 14. In the illustrated embodiment, stem portion 24 is coplanar with a cross-sectional plane of the body 12, and its axis is nearly perpendicular to the axis of the body 12, but tending to be inclined slightly such that the end 26 of the stem portion 24 points forward. This configuration tends to work well in conjunction with many kinds of power driven tools since it tends to coincide with a natural direction of the pull force (hence starter pull cord) in relation to the axis defined by a user's gripping hand. However, it is recognized that in some embodiments of the starter pull cord handle 10, the stem portion 24 may be completely perpendicular to the axis of the body 12, or it may be inclined towards the back, and/or towards a side, depending on the specific nature of the device on which it is used.

The bottom outer surface 22 of the body 12 includes a plurality of rounded indentations or narrow portions adapted to accommodate the fingers of the user's gripping hand, thereby providing an ergonomic fit as well as an enhanced grip. A first indentation 32 is provided behind an enlarged circumferential portion 30, which is adjacent the front end 14, and in front of the base of the stem portion 24. The first indentation 32 accommodates and locates a user's index (or first) finger between the enlarged circumferential portion 30 and the base of the stem portion 24, thereby providing an enhanced grip to reduce slippage of the starter pull cord handle 10 in the user's hand. A second indentation 34 is provided behind the base of the stem portion 24 to accommodate and locate a user's middle (or second) finder on the starter pull cord handle 10, and thereby also providing an enhanced grip. Since the stem portion 24 is located between the two strongest fingers of a user's gripping hand, and those fingers are located within their respective indentations, the enhanced grip this configuration provides significantly reduces slippage of the handle and virtually eliminates loss of grip on the handle during the act of pull starting the apparatus on which the starter pull cord handle 10 is provided.

Figure 28:
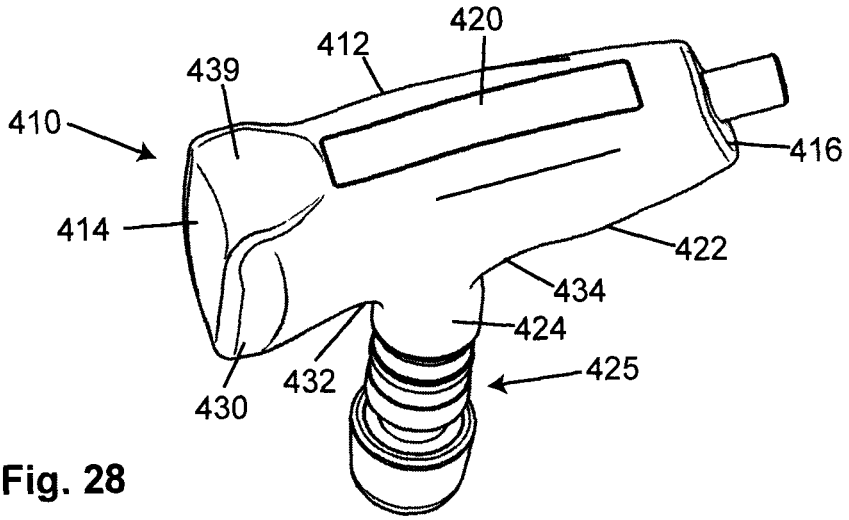
FIG. 28 is a perspective view of another embodiment of a starter pull cord handle in accordance with the present invention.
Figure 29:
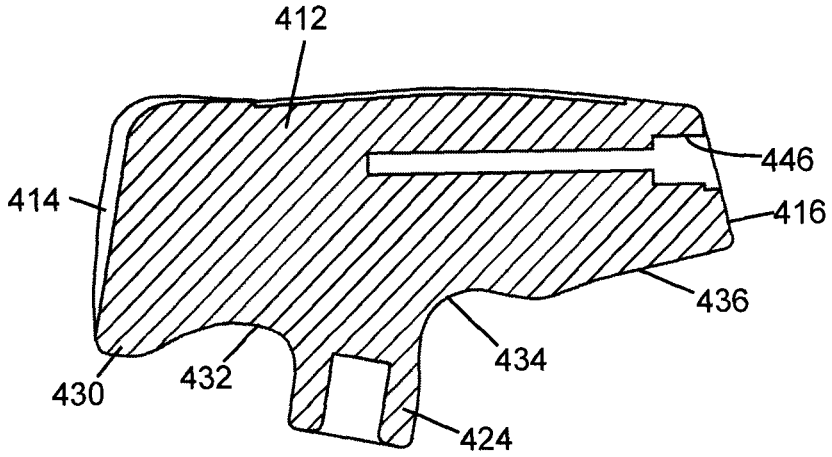
FIG. 29 is a longitudinal section of the handle body of the starter pull cord handle of FIG. 28.

A third indentation 36 is provided behind the second indentation 34, and a fourth indentation 38 is provided to the rear of the third indentation 36. The third indentation 36 and the fourth indentation 38 accommodate the ring (third) and the pinkie (fourth) fingers respectively of the user's gripping hand. And a top indentation 39 on the top surface of the body 12 behind the enlarged circumferential portion 30 may accommodate the base of the user's thumb. The indentations 36, 38 and 39 also assist in providing an enhanced grip to the user. In some embodiments, particularly on smaller devices (with smaller engines), the body 12 may be shorter to provide a smaller overall size of the starter pull cord handle 10, in which case the fourth indentation 38 may be omitted altogether (as shown in FIGS. 28 and 29).

The body 12, at the front end 14, includes a longitudinal cylindrical cavity 44 comprising of a larger portion 46 that extends from the front end 14 to approximately the middle of the body 12, and a smaller portion 48 that continues a distance further. A bore 52 is provided in the body 12 that intersects the rear portion of the larger portion 46 of the cylindrical cavity 44 in a manner such that a rod received within the bore 52 is a secant to that portion of the larger portion 46. The opening of the bore 52 communicates with a longitudinal channel 54 provided in the outer surface of the body 12. Accordingly, the bore 52 together with the channel 54 are adapted to accommodate a tool 56. The tool 56 comprises of a rod-like stem 58 connected at right angle to a rod-like handle portion 60. The stem 58 is received within the bore 52, and invades the larger portion 46 of the cylindrical cavity 44, and once fully inserted, the handle portion 60 is received within channel 54. The terminus of stem 58 is provided with a tool tip 62, which may be a screw driver tip, a hexagonal tool, or some other tool configuration as desired, preferably one that is particularly relevant to the device on which the starter pull cord handle 10 is provided.

A spark plug tool 66, having an open end 74 and a closed end 75, and a cylindrical outer surface 68 that is complementary to the inside surface 54 of the larger portion 46, is removably received within the larger portion 46. The outer surface 68 comprises a cylindrical sleeve portion 70 that defines two coaxial cavities on the inside: an outer cavity 72 at the open end 74 of the spark plug tool 66 that has a hexagonal inside wall, and a smaller diameter, cylindrical inner cavity 76. The cavities are dimensioned to accommodate a spark plug A therein. The inner cavity 76 accommodates the insulator portion insulator portion B of the spark plug A, and the outer cavity 72 accommodates the hexagonal metal case C of the spark plug A.

The closed end 75 of the spark plug tool 66 includes an axially aligned connector portion 88 comprised of a cylindrical portion 90 that terminates in a square tip 92. The cylindrical portion 90 includes a circumferential round groove 94 adjacent the closed end 75. The square tip 92 is preferably sized to fit the head of a standard socket set, such as a standard ¼", ⅜" or ½" socket set.

Figure 3:
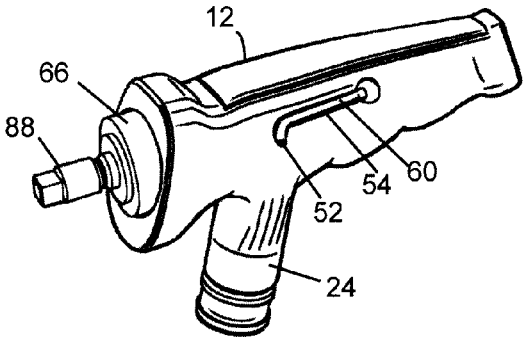
FIG. 3 is a perspective view from the side of the starter pull cord handle of FIG. 1 shown with a spark plug tool received in the handle body, exposing a standard square tip for use with standard sockets.
Figure 4:
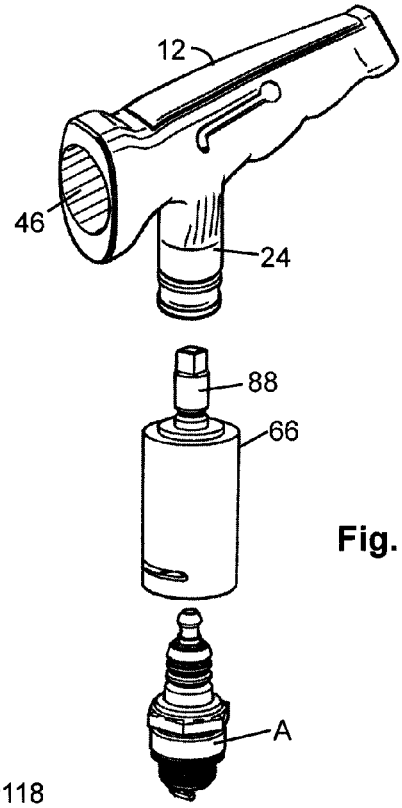
FIG. 4 is an exploded perspective view of the starter pull cord handle of FIG. 1 shown with the spark plug tool and a spark plug.

The outer surface of the sleeve portion 70, near the open end 74, includes a groove or cut 78 that aligns with the bore 52 when the spark plug tool 66 is within the larger portion 46 of the cylindrical cavity 44, and the groove or cut 78 is adapted to receive the stem 58 of the tool 56 when the tool 56 is inserted into the bore 52. In this configuration, with the stem 58 in engagement with the groove or cut 78, the spark plug tool 66 is releasably locked to the body 12 and it is prevented from rotating within the cylindrical cavity 44. The foregoing structure is an example of a releasable locking means on the elongate body adapted to cooperate with the spark plug tool within the elongate body to restrict removal and rotation of the spark plug tool relative to the elongate body for enabling the handle to being used in driving other tools having portions complementary to and able to connect with the second male portion on the spark plug tool. Advantageously, in this locked configuration, the entire starter pull cord handle 10 may be used as a driver for other tools that have matching heads to the square tip 92 (as shown in FIG. 3), such as standard sockets, various screw driver sockets, hex tool sockets, and the like. In addition, custom tools with heads matching the square tip 92 may be provided to suit the particular needs of the device on which the starter pull cord handle 10 is used.

In addition to the storage of the spark plug tool 66 within the body 12 of the starter pull cord handle 10, a spare spark plug A may also be stored within the body 12, as well as the spark plug tool 66, for safety and convenience should the need for a spare spark plug arise during operation of the motorized device in remote locations. The threaded portion D of a spark plug A is received within the smaller portion 48 of the cylindrical cavity 44, and the rest of the spark plug A is received within the spark plug tool 66 when the spark plug tool 66 is within the cylindrical cavity 44. And if the spark plug needs to be replaced, the spark plug tool 66 may be removed from the body 12 and used to remove and replace a spark plug on the motor of the device, as described herein (and shown in FIG. 4).

The end 26 of the stem portion 24 includes a female portion of quick connect coupling mechanism comprising cylindrical sleeve 102 that defines a cylindrical cavity 104 therein that terminates in a square cavity 106. The starter pull cord handle 106 is sized to fit over the square tip 92 of the spark plug tool 66, which preferably, is also the same size as a square tip of a standard socket set, such as a standard ¼", ⅜" or ½" socket set. The sleeve 102 adjacent its opening includes a pair of ball bearings 108 received within complementary recesses, and an outer sleeve 110 that is slidably connected to the sleeve 102. The inside of the outer sleeve 110 has cam surfaces that engage or disengage the ball bearings 108 as the outer sleeve 110 is slid in relation to the sleeve 102, such that in one position, the outer sleeve 110 causes the ball bearings 108 to invade into the cavity 104, and in the other position the outer sleeve 110 permits the ball bearings 108 to be pushed out of the cavity 104. The ball bearings 108 are located a distance from the end of the cavity 104 that coincides with the distance from the tip of the square tip 92 to the groove 94 on the connector portion 88 of the spark plug tool 66. Thus, when the male connector portion 88 is within the cavity 104, the ball bearings 108 are able to engage the groove 94. Accordingly, these structures provide a quick connect/release coupling or connector mechanism that is able to engage and disengage the connector portion 88 of the spark plug tool 66, or any analogous connector portion. As well, the square tip 92 and the square cavity 106 provide complementary interlocking portions that cooperate when the male portion is engaged with the female portion to prevent rotation of the male portion relative to the female portion, thereby enabling the handle to be used in torquing applications.

To use the spark plug tool 66, it is removed from the body 12 of the starter pull cord handle 10, and its connector portion 88 is inserted into the cavity 104 of the sleeve 102, while the outer sleeve 110 is slid to allow the ball bearings 108 to be clear of the cavity 104. The spark plug tool 66 may need to be rotated slightly so that the square tip 92 aligns with the square cavity 106, and once the connector portion 88 is seated completely within the sleeve 102, the outer sleeve 110 is slid (or allowed to slide if it is spring biased) to a position in which it causes the ball bearings 108 to invade into the cavity 104, and into engagement with the groove 94 of the connector portion 88, thereby locking the spark plug tool 66 to the stem portion 24 of the starter pull cord handle 10. In this configuration, the starter pull cord handle 10 may be used as a handle for the spark plug tool 66. Once finished, the spark plug tool 66 is released from the stem portion 24, and returned into the cylindrical cavity 44 of the starter pull cord handle 10.

Advantageously, other tools may be provided that have a connector portion analogous to the connector portion 88 of the spark plug tool 66, and thereby such tools may be releasably coupled to the starter pull cord handle 10 so that the handle can be used as a handle for the tool. For example, a chain sharpening tool with an analogous connector portion could be coupled to the starter pull cord handle 10, thereby providing a convenient handle for such tool—one that fits ergonomically in the user's hand and that provides an enhanced grip to the user for confident control of the tool.

Figure 5:
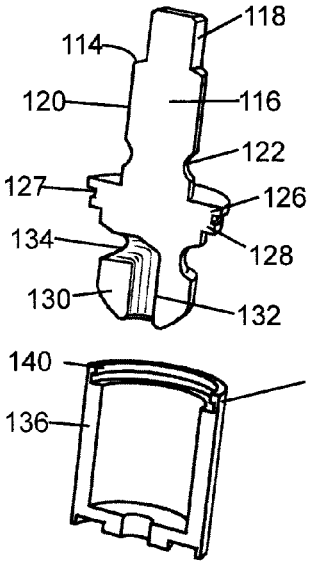
FIG. 5. is a longitudinal section of an embodiment of a cord connector for the handle of FIG. 1 to a starter cord.
Figure 6:
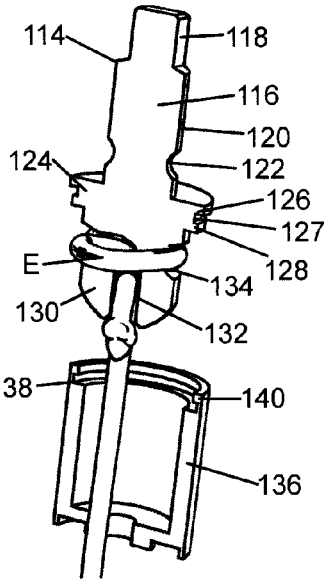
FIG. 6 is a longitudinal section of the cord connector of FIG. 5 shown connected to a starter cord.
Figure 7:
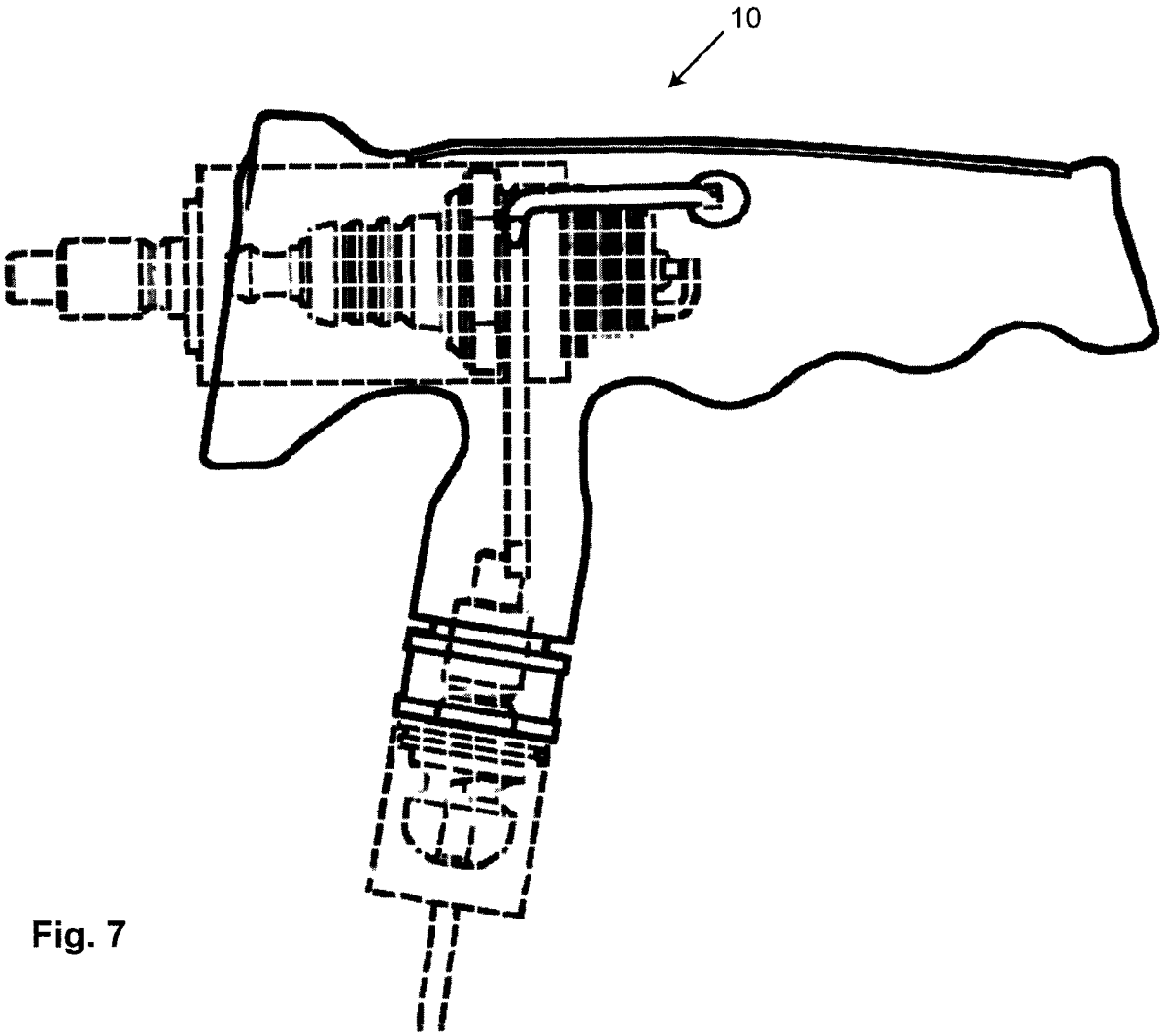
FIG. 7 is a side view of the handle of FIG. 1 with the internal structure shown in phantom lines.

In FIGS. 5 and 6, there is shown an embodiment of a cord connector 114 for connecting the starter pull cord handle 10 to a starter pull cord E. The cord connector 114 comprises a connector portion 116 that is analogous to the connector portion 88 of the spark plug tool 66; therefore, it includes a square tip 118 that fits into the square cavity 106, a cylindrical portion 120 that fits within the cavity 104, and a circumferential round groove 122 at its base which can be engaged by the ball bearings 108. The base of the connector portion 116 is attached to an enlarged disk collar 124 having circumferential flanges 126 and 128 that define a groove 127 there between. On the side of the disk collar 124 opposite of the connector portion 116, there is provided a cord gripping member 130 which has a central vertical groove 132 that communicates with a circumferential horizontal groove 134. An end of a starter pull cord E is passed into the vertical groove 132, then wound around the horizontal groove 134, and the remaining free end of the starter pull cord E is passed in between the cord and the vertical groove 132. The starter pull cord E below the cord connector 114 is pulled taught to tighten the cord around the cord gripping member 130. A cylindrical cover 136 for the cord gripping member 130 is provided, and includes a lip portion 138 with a flange 140 that snaps into engagement with the groove 127 on the disk collar 124.

Figure 8:
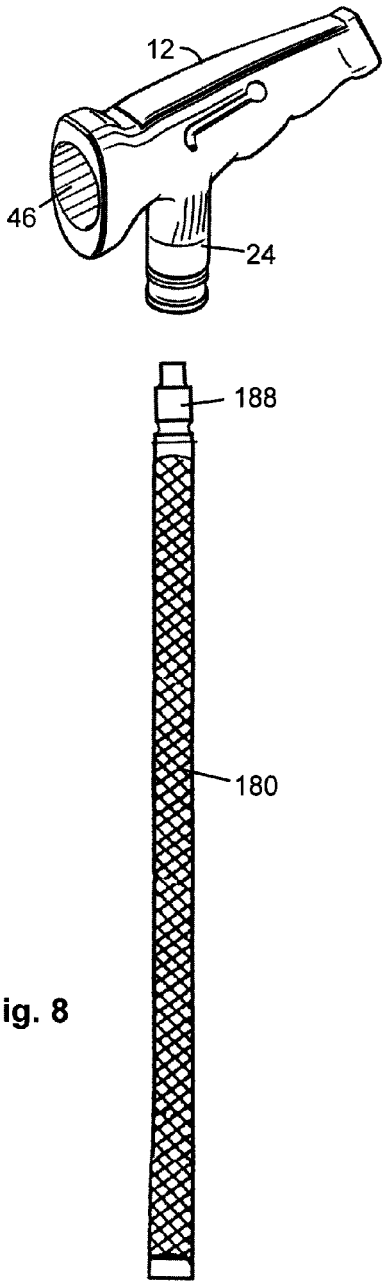
FIG. 8 is an exploded perspective view of the starter pull cord handle of FIG. 1 shown with a hand file tool having a complementary connector portion.
Figure 9:
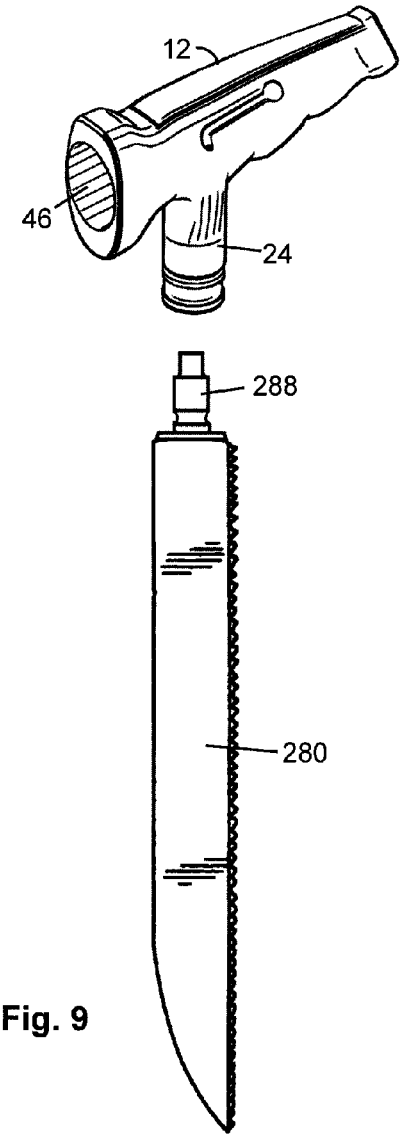
FIG. 9 is an exploded perspective view of the starter pull cord handle of FIG. 1 shown with a hand saw tool having a complementary connector portion.
Figure 10:
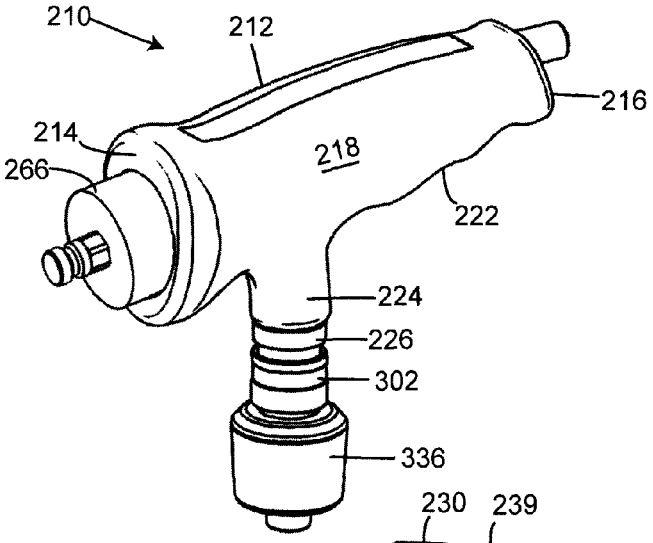
FIG. 10 is a perspective view of another embodiment of a starter pull cord handle in accordance with the present invention.
Figure 11:
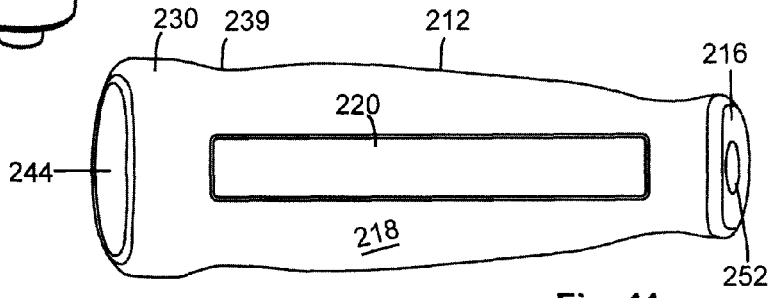
FIG. 11 is a top view of the starter pull cord handle of FIG. 10.
Figure 12:
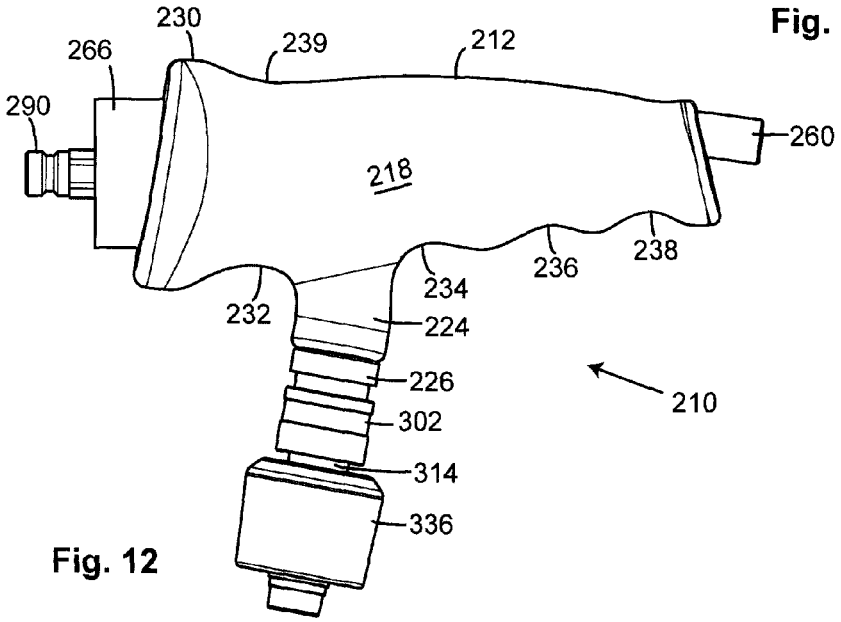
FIG. 12 is a side view of the starter pull cord handle of FIG. 10.
Figure 13:
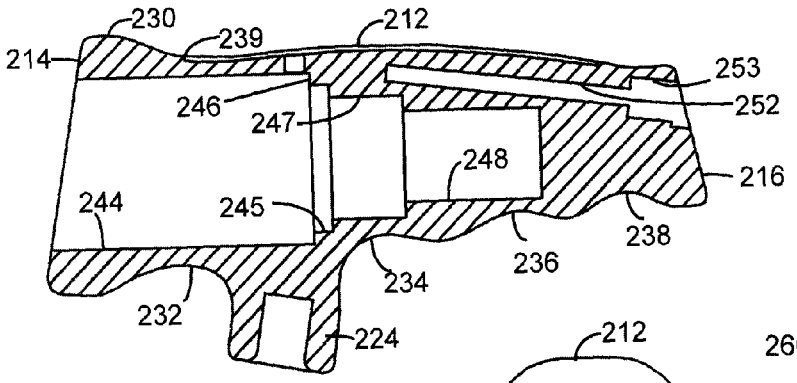
FIG. 13 is a longitudinal section of the handle body of the starter pull cord handle of FIG. 10.
Figure 15:
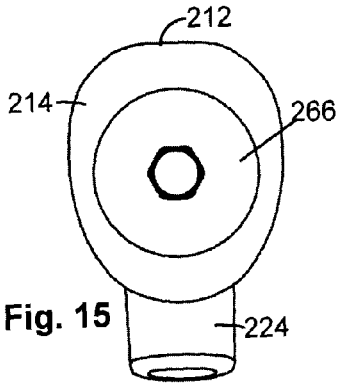
FIG. 15 is a front view of the handle body of the starter pull cord handle of FIG. 10.
Figure 16:
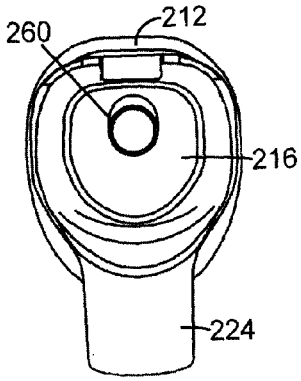
FIG. 16 is a back view of the handle body of the starter pull cord handle of FIG. 10.

In use, the starter pull cord handle 10 is coupled to the cord connector 114 in the same manner as described herein in relation to the spark plug tool 66 (i.e. the connector portion 116 is coupled to the quick connector mechanism on the stem portion 24). The starter pull cord handle 10 may then be used to pull start the motor of the device on which it is used. The handle may be left on the device, coupled to the starter pull cord, or it may be released from the cord and stowed out of the way. While released from the pull cord, the starter pull cord handle 10 may be used with a variety of complementary tools or implements made available for use in conjunction with a particular motorized device. For example, the handle may be used as a handle for a hand file tool 180 that is provided with a connector portion 188 (FIG. 8), for sharpening chainsaws. And it may be used as a handle for a hand saw tool 280 that is provided with a connector portion 288 (FIG. 9).

Referring to FIGS. 10-27, there is shown another embodiment of a starter pull cord handle, in accordance with the present invention, shown generally by reference numeral 210. Handle 210 comprises an elongate body 212 having a front end 214 and an opposite back end 216, and slightly convex side surfaces 218. The body 212 tapers from a larger cross section at the front end 214 to a smaller cross section towards the back end 214, and thereby the body 212 is adapted to more naturally conform to the inside of a user's hand while gripping the starter pull cord handle 210. The top outer surface of the body 212 includes a top panel portion 220 that smoothly tapers with the remainder of the body 212.

Starter pull cord handle 210 includes a stem portion 224 that extends from the bottom outer surface 222 of the body 212 preferably nearer the front end 214 than the back end 214. In the illustrated embodiment, stem portion 224 is coplanar with a cross-sectional plane of the body 212, and its axis is nearly perpendicular to the axis of the body 212, but tending to be inclined slightly such that the end 226 of the stem portion 224 points forward. This configuration tends to work well in conjunction with many kinds of power driven tools since it tends to coincide with a natural direction of the pull force (hence starter pull cord) in relation to the axis defined by a user's gripping hand. However, it is recognized that in some embodiments of the starter pull cord handle 210, the stem portion 224 may be completely perpendicular to the axis of the body 212, or it may be inclined towards the back, and/or towards a side, depending on the specific nature of the device on which it is used.

The bottom outer surface 222 of the body 212 includes a plurality of rounded indentations or narrow portions adapted to accommodate the fingers of the user's gripping hand, thereby providing an ergonomic fit as well as an enhanced grip. A first indentation 232 is provided behind an enlarged circumferential portion 230, which is adjacent the front end 214, and in front of the base of the stem portion 224. The first indentation 232 accommodates and locates a user's index (or first) finger between the enlarged circumferential portion 30 and the base of the stem portion 224, thereby providing an enhanced grip to reduce slippage of the starter pull cord handle 210 in the user's hand. A second indentation 234 is provided behind the base of the stem portion 224 to accommodate and locate a user's middle (or second) finder on the starter pull cord handle 210, and thereby also providing an enhanced grip. Since the stem portion 224 is located between the two strongest fingers of a user's gripping hand, and those fingers are located within their respective indentations, the enhanced grip this configuration provides significantly reduces slippage of the handle and virtually eliminates loss of grip on the handle during the act of pull starting the apparatus on which the starter pull cord handle 210 is provided.

A third indentation 236 is provided behind the second indentation 234, and a fourth indentation 238 is provided to the rear of the third indentation 236. The third indentation 236 and the fourth indentation 238 accommodate the ring (third) and the pinkie (fourth) fingers respectively of the user's gripping hand. And a top indentation 239 on the top surface of the body 212 behind the enlarged circumferential portion 230 may accommodate the base of the user's thumb. The indentations 236, 238 and 239 also assist in providing an enhanced grip to the user. In some embodiments, particularly on smaller devices (with smaller engines), the body 212 may be shorter to provide a smaller overall size of the starter pull cord handle 210, in which case the fourth indentation 238 may be omitted altogether (as shown in FIGS. 28 and 29).

The body 212, at the front end 214, includes a longitudinal cylindrical cavity 244 that extends from the front end 214 to approximately the middle of the body 212. A slightly smaller cylindrical cavity 245 is provided rearward of cavity 244 is coaxial therewith, and thereby defines a shoulder 246. To the rear of cavity 245 may be provided two progressively smaller coaxial cavities 247 and 248, which are adapted to receive a portion of a spark plug that may be stored in the body 212. A bore 252 is provided in the back end 216 of body 212 that extends forward adjacent to the cavities 247 and 248 but not communicating therewith. The opening of the bore 252 adjacent to the back end 216 includes a larger diameter portion 253. Accordingly, the bore 252 together with the larger diameter portion 253 are adapted to accommodate a tool such as for example a small crew driver 256 having a rod-like stem 258 connected to a handle portion 260. The stem 258 is received within the bore 252, and the handle portion 260 is received within the larger diameter portion 253. The terminus of stem 258 is provided with a tool tip 262, which may be a screw driver tip, a hexagonal tool, or some other tool configuration as desired, preferably one that is particularly relevant to the device on which the starter pull cord handle 210 is provided.

A spark plug tool 266, having an open end 274 and a closed end 275, and a cylindrical outer surface 268 that is complementary to the inside surface of cylindrical cavity 244, is removably received within cavity 244. The outer surface 268 comprises a cylindrical sleeve portion 270 that defines four coaxial cavities 271, 273, 277 and 279 on the inside that are stepped from the larger diameter cavity 279 being at the open end 274, and the smaller diameter cavity 271 being on the inside. Cavities 273, 277 and 279 have hexagonal inside walls and are relatively narrow cavities, whereas cavity 271 on the inside has a cylindrical inner wall and is relatively wide. The cavities 271, 273, 277 and 279 are adapted to being able to accommodate three sizes of spark plug therein. The inner cavity 271 accommodates the insulator portion of the spark plug, and one of cavities 273, 277 and 279 accommodates the hexagonal metal case of the spark plug. By having the stepped hexagonal cavities 273, 277 and 279, the spark plug tool 266 may be used with three sizes of spark plugs, preferably the more common sizes for the kind of device on which the handle 210 is used, so that the spark plug tool 266 is more versatile than the spark plug tools in the prior art.

The closed end 275 of the spark plug tool 266 includes an axially aligned connector portion 288 comprised of a hexagonal portion 290 that terminates in a cylindrical portion 292. The cylindrical portion 292 includes a circumferential round groove 294.

In addition to the storage of the spark plug tool 266 within the body 212 of the starter pull cord handle 210, a spare spark plug may also be stored within the body 212, as well as the spark plug tool 266, for safety and convenience should the need for a spare spark plug arise during operation of the motorized device in remote locations. The threaded portion of a spark plug may be received within the cavities 247 and 248, and the rest of the spark plug may be received within the spark plug tool 266 when the spark plug tool 266 is within the cylindrical cavity 244. And if a spark plug needs to be replaced, the spark plug tool 266 may be removed from the body 212 and used to remove and replace a spark plug on the motor of the device, as described herein (and shown in FIG. 4).

Referring to FIGS. 14 and 23-25, the stem portion 224 is fixedly connected to a female portion 226 of a quick connect coupling connector. The female portion 226 comprises a cylindrical core 281 having a connector stem 282 adapted to connecting with the stem portion 224 of the body 212. The core 281 at the end opposite of the connector stem 282 includes an outer cavity 282 having a hexagonal inner wall, and a coaxial inner cavity 283 having a cylindrical inner wall. The portion of the core 281 adjacent the inner cavity 283 includes bores 284 that communicate with the inner cavity 283, and each is provided with a ball bearing 285. A sleeve 302 is slidably mounted around the core 281 and includes cam portions 286 on the inside, each cam portion 286 being proximate to a bore 284. The sleeve 302 is biased by coil spring 287 towards a position whereby the cam portions 286 cover the bores 284 thereby causing the ball bearings 285 to be pushed inwards so that they invade into the inner cavity 283. The sleeve 302 may be slid against the bias of the spring 287 to move the cam portions 286 clear of the bores 284, thereby allowing the ball bearings 285 to be pushed out of the inner cavity 283. Accordingly, the sleeve 302 engages or disengages the ball bearings 285 as the sleeve is slid in relation to the core 281, such that in an engaged position, the sleeve 302 causes the ball bearings 285 to invade into the inner cavity 283, and in the disengaged position the sleeve 302 permits the ball bearings 285 to be pushed out of the inner cavity 283.

The ball bearings 285 are located a distance from the end of the cavity 283 that coincides with the distance from the tip of the cylindrical tip 292 to the groove 294 on the connector portion 288 of the spark plug tool 266. Thus, when the connector portion 288 is within the cavity 283, the ball bearings 285 are able to engage the groove 294. Accordingly, these structures provide a quick release connector mechanism that is able to engage and disengage the connector portion 288 of the spark plug tool 266, or any analogous connector portion. When connected, the hexagonal portion 290 on the spark plug tool 266 is adapted to fit within the hexagonal cavity 282 of the female connector on the handle 212 in a manner that prevents rotation of the spark plug tool 266 relative to the handle 212. Thus the hexagonal portion 290 and the hexagonal cavity 282 provide complementary interlocking portions that cooperate when the male portion is engaged with the female portion to prevent rotation of the male portion relative to the female portion, thereby enabling the handle to be used in torquing applications. Accordingly, the handle 212 may be used to rotationally drive the spark plug tool 266, or any other tool having an analogous male connector portion.

To use the spark plug tool 266, it is removed from the body 212 of the starter pull cord handle 210, and its male connector portion 288 is inserted into the cavity 283 of the female connector, while the sleeve 302 is slid to the disengaged position to allow the ball bearings 285 to be clear of the cavity 283. The spark plug tool 266 may need to be rotated slightly so that the hexagonal portion 290 aligns with the hexagonal cavity 282, and once the connector portion 288 is seated completely within the female connector, the sleeve 302 is allowed to slide by the action of spring 287 to a position in which it causes the ball bearings 285 to invade into the cavity 283, and into engagement with the groove 294 of the connector portion 288, thereby locking the spark plug tool 266 to the stem portion 224 of the starter pull cord handle 210. In this configuration, the starter pull cord handle 210 may be used as a handle for the spark plug tool 266. Once finished, the spark plug tool 266 is released from the stem portion 224, and returned into the cylindrical cavity 244 of the starter pull cord handle 210.

Advantageously, other tools may be provided that have a connector portion analogous to the connector portion 288 of the spark plug tool 266, and thereby such tools may be releasably coupled to the starter pull cord handle 210 so that the handle can be used as a handle for the tool. For example, a chain sharpening tool with an analogous connector portion could be coupled to the starter pull cord handle 210, thereby providing a convenient handle for such tool—one that fits ergonomically in the user's hand and that provides an enhanced grip to the user for confident control of the tool.

Figure 14:
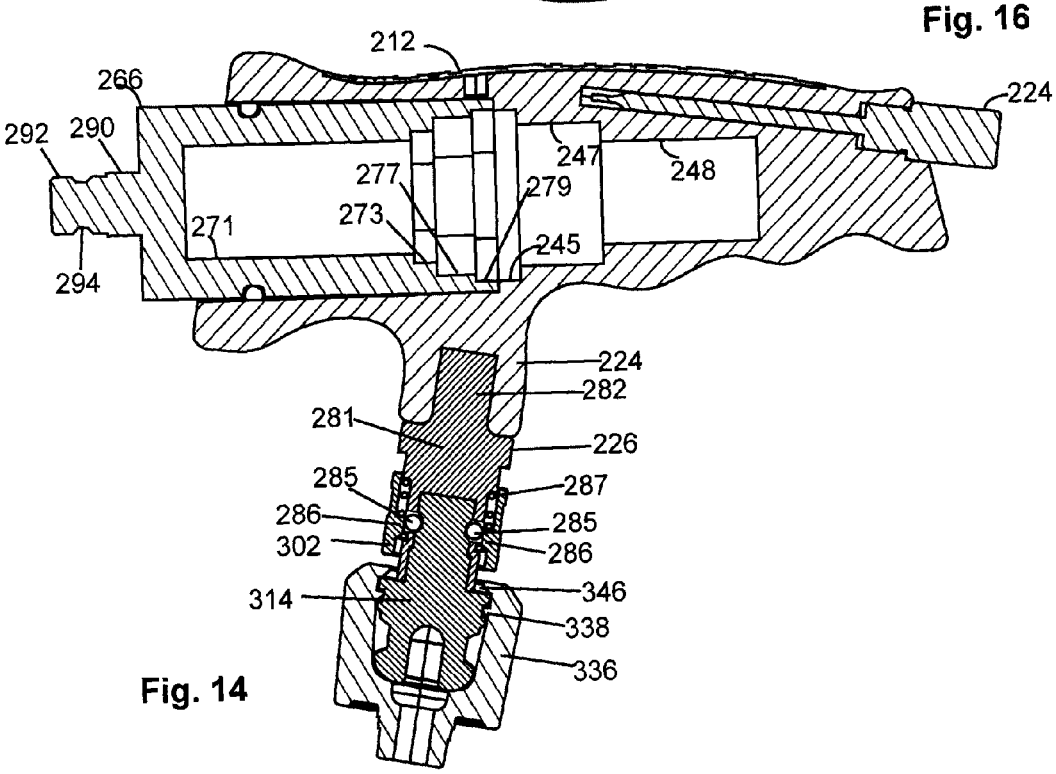
FIG. 14 is a longitudinal section of the starter pull cord handle of FIG. 10.

In FIGS. 14, 26 and 27, there is shown an embodiment of a cord connector 314 for connecting the starter pull cord handle 210 to a starter pull cord. The cord connector 314 comprises a male connector portion 316 that is analogous to the connector portion 318 of the spark plug tool 266; therefore, it includes an axially aligned connector portion 288 comprised of a hexagonal portion 289 that terminates in a cylindrical portion 293. The cylindrical portion 293 includes a circumferential round groove 295, which may be engaged by the ball bearings 285. The base of the connector portion 316 is attached to an enlarged disk collar 324 having circumferential flanges 326 and 328 that define a groove 327 there-between. On the end of the disk collar 324 opposite of the connector portion 316, there is provided a cord gripping member 330 which has an axial vertical bore 332 that communicates with a circumferential horizontal groove 334. An end of a starter pull cord is passed into the vertical bore 332, then wound around the horizontal groove 334, and the remaining free end of the starter pull cord is passed in between the cord and the vertical groove 332. The starter pull cord below the cord connector 314 is pulled taught to tighten the cord around the cord gripping member 330. A cylindrical cover 336 for the cord gripping member 330 is provided, and includes lip portions 338 and 340 that snaps into engagement with the groove 327 and the disk collar 324.

In use, the starter pull cord handle 210 is coupled to the cord connector 314 in the same manner as described herein in relation to the spark plug tool 266 (i.e. the male connector portion 316 is coupled to the female quick connector mechanism on the stem portion 224). The starter pull cord handle 210 may then be used to pull start the motor of the device on which it is used. The handle may be left on the device, coupled to the starter pull cord, or it may be released from the cord and stowed out of the way. While released from the pull cord, the starter pull cord handle 210 may be used with a variety of complementary tools or implements made available for use in conjunction with a particular motorized device. For example, the handle 210 may be used as a handle for a hand file tool (similar to 180 in FIG. 8) for sharpening chainsaws that may be provided with a male connector portion having the same structures as male connector portions 288 and 316. As well, the handle 210 may be used as a handle for a hand saw tool (similar to 280 in FIG. 9) that is provided with a connector portion 288 (FIG. 9) may be provided with an analogous male connector portion.

Referring to FIGS. 28 and 29, there is shown another embodiment of a starter pull cord handle, in accordance with the present invention, shown generally by reference numeral 410. Handle 410 comprises an elongate body 412 having a front end 414 and an opposite back end 416, and slightly convex side surfaces 418. The body 412 tapers from a larger cross section at the front end 414 to a smaller cross section towards the back end 414, and thereby the body 412 is adapted to more naturally conform to the inside of a user's hand while gripping the starter pull cord handle 410. The top outer surface of the body 412 may include a top panel portion 420 that smoothly tapers with the remainder of the body 412.

Starter pull cord handle 410 includes a stem portion 424 that extends from the bottom outer surface 422 of the body 412 preferably nearer the front end 414 than the back end 414. In the illustrated embodiment, stem portion 424 is coplanar with a cross-sectional plane of the body 412, and its axis is nearly perpendicular to the axis of the body 412, but tending to be inclined slightly such that the end 426 of the stem portion 424 points forward. This configuration tends to work well in conjunction with many kinds of power driven tools since it tends to coincide with a natural direction of the pull force (hence starter pull cord) in relation to the axis defined by a user's gripping hand. However, it is recognized that in some embodiments of the starter pull cord handle 410, the stem portion 424 may be completely perpendicular to the axis of the body 412, or it may be inclined towards the back, and/or towards a side, depending on the specific nature of the device on which it is used. The stem portion 424 may be connected to a quick connect coupling mechanism 425 similar to those described for handles 10 or 210 herein.

The bottom outer surface 422 of the body 412 includes a plurality of rounded indentations or narrow portions adapted to accommodate the fingers of the user's gripping hand, thereby providing an ergonomic fit as well as an enhanced grip. A first indentation 432 is provided behind an enlarged circumferential portion 430, which is adjacent the front end 414, and in front of the base of the stem portion 424. The first indentation 432 accommodates and locates a user's index (or first) finger between the enlarged circumferential portion 430 and the base of the stem portion 424, thereby providing an enhanced grip to reduce slippage of the starter pull cord handle 410 in the user's hand. A second indentation 434 is provided behind the base of the stem portion 424 to accommodate and locate a user's middle (or second) finder on the starter pull cord handle 410, and thereby also providing an enhanced grip. Since the stem portion 424 is located between the two strongest fingers of a user's gripping hand, and those fingers are located within their respective indentations, the enhanced grip this configuration provides significantly reduces slippage of the handle and virtually eliminates loss of grip on the handle during the act of pull starting the apparatus on which the starter pull cord handle 410 is provided. A tapering portion 436 is provided behind the second indentation 434, and may accommodate the ring (third) and possibly the pinkie (fourth) fingers respectively of the user's gripping hand. And a top indentation 439 on the top surface of the body 412 adjacent the front end 414 may accommodate the base of the user's thumb.

This embodiment of handle 410 omits a cavity for carrying a spark plug tool, but includes a cavity 440 that may be adapted to holding a tool 256, or the like. Additional cavities may be provided for other tools.

While selected embodiments have been chosen to illustrate the present invention, it will be apparent to those skilled in the art from this disclosure that various changes and modifications can be made herein without departing from the scope of the invention. Furthermore, the foregoing description of the embodiments according to the present invention are provided for illustration only, and not for the purpose of limiting the invention.

What is claimed is:

1. A handle for a starter pull cord for use on a motor driven device, the handle comprising:

an elongate body adapted to being grasped in a user's grasping hand and having at least one cavity adapted to releasably retain therein a tool that is relevant to the device;

a stem portion extending downward from the elongate body and having a base portion attached to the elongate body at a position that is located between two fingers of the user's grasping hand, and a remote end opposite the base end;

a female portion of a quick connect/release coupling mechanism attached to the remote end of the stem portion, the female portion comprising a core member and a sleeve mounted for sliding movement on the core member between an engaged position and a disengaged position, the sleeve being biased towards the engaged position;

a cord connector adapted to being attached to the starter pull cord and having a first male portion of the quick connect/release coupling mechanism that is adapted to being received within the female portion and being releasably retained therein when the sleeve is in the engaged position and being released therefrom when the sleeve is in the disengaged position, wherein the first male portion and the female portion include complementary interlocking portions that cooperate when the first male portion is engaged with the female portion to prevent rotation of the first male portion relative to the female portion; and a spark plug tool, and wherein one of said at least one cavity is longitudinally aligned with the elongate body and is adapted to receive the spark plug tool therein.

2. The handle as claimed in claim 1 wherein said one cavity is adapted to receive the spark plug tool and a spark plug partially retained in the spark plug tool.

3. The handle as claimed in claim 1 wherein the spark plug tool includes a second male portion of the quick connect/release coupling mechanism that is adapted to being received within the female portion on the handle and being releasably retained therein when the sleeve is in the engaged position and being released therefrom when the sleeve is in the disengaged position.

4. The handle as claimed in claim 1 further including releasable locking means on the elongate body adapted to cooperate with the spark plug tool within the elongate body to restrict removal and rotation of the spark plug tool relative to the elongate body for enabling the handle to being used in driving other tools having portions complementary to and able to connect with the second male portion on the spark plug tool.

5. The handle as claimed in claim 1 wherein the spark plug tool includes at least two stepped internal hexagonal cavities, each being adapted to engage with a size of spark plug thereby enabling the spark plug tool to drive more than one sized spark plug.

6. The handle as claimed in claim 1 wherein the elongate body includes a front end and an opposite back end, and tapers from the front end toward the back end.

7. The handle as claimed in claim 6 further including a first concave indentation adjacent the front end adapted to locating the index finger of the user's grasping hand therein, and a second concave indentation to the rear of the first indentation and adapted to locating the middle finger of the user's grasping hand.

8. The handle as claimed in claim 7 wherein the base portion of the stem portion is between the first indentation and the second indentation.

9. The handle as claimed in claim 7 wherein the elongate body further includes a top indentation adjacent the front end adapted to locate the thumb of the user's grasping hand therein.

10. A tool kit comprising:

a handle for a starter pull cord for use on a motor drive device, the handle comprising:

an elongate body adapted to being grasped in a user's grasping hand;

a stem portion extending downward from the elongate body and having a base portion attached to the elongate body at a position that is located between two fingers of the user's grasping hand, and a remote end opposite the base end;

a female portion of a quick connect/release coupling mechanism attached to the remote end of the stem portion, the female portion comprising a core member and a sleeve mounted for sliding movement on the core member between an engaged position and a disengaged position, the sleeve being biased towards the engaged position; and a plurality of tools, each tool having a male portion of the quick connect/release coupling mechanism that is adapted to being received within the female portion on the handle and being releasably retained therein when the sleeve is in the engaged position and being released therefrom when the sleeve is in the disengaged position, wherein the male portion and the female portion include complementary interlocking portions that cooperate when the first male portion is engaged with the female portion to prevent rotation of the first male portion relative to the female portion.

11. The tool kit as claimed in claim 10 wherein the handle further includes at least one cavity, wherein each of the at least one cavity is adapted to releasably retain therein one of said plurality of tools.

12. The tool kit as claimed in claim 11 wherein one of said plurality of tools comprises a spark plug tool, and one of said at least one cavity is longitudinally aligned with the elongate body and is adapted to receive the spark plug tool therein.

* * * * *